United States Patent [19]

Law

[11] 4,443,968

[45] Apr. 24, 1984

[54] FOUR WHEEL DRIVE TOY VEHICLE

[75] Inventor: N. Y. Law, Kowloon, Hong Kong

[73] Assignee: Soma Traders, Ltd., Kowloon, Hong Kong

[21] Appl. No.: 378,878

[22] Filed: May 17, 1982

[51] Int. Cl.[3] ..... A63H 17/00

[52] U.S. Cl. ..... 46/251

[58] Field of Search ..... 46/251, 252, 253, 254, 46/256, 201, 217, 262, 230

[56] References Cited

U.S. PATENT DOCUMENTS

| | | | |
|---|---|---|---|
| 2,739,541 | 3/1956 | Varney | 105/119 |
| 3,014,433 | 12/1961 | Durand | 105/97 |
| 3,114,217 | 12/1963 | Rexford | 46/241 |
| 3,120,719 | 2/1964 | Simonds | 46/17 |
| 3,501,863 | 3/1970 | Matsushiro | 46/251 |
| 3,628,284 | 12/1971 | Soulakis | 46/243 |
| 3,810,515 | 5/1974 | Ingro | 46/243 |
| 3,849,931 | 11/1974 | Gulley, Jr. | 46/244 |
| 4,306,375 | 12/1981 | Goldfarb | 46/251 |

FOREIGN PATENT DOCUMENTS

| | | | |
|---|---|---|---|
| 1303241 | 1/1973 | United Kingdom | 46/262 |

*Primary Examiner*—Mickey Yu

*Attorney, Agent, or Firm*—Buell, Blenko, Ziesenheim & Beck

[57] ABSTRACT

A miniature self-powered four wheel drive vehicle is disclosed which will climb grades of about 50°. The vehicle is powered by a small electric motor positioned over the front wheel axle and having its center of mass in front of the axle, and a AA battery located behind and perpendicular to the motor. A propeller shaft extends the length of the vehicle and has a crown gear which engages a pinion on the motor drive shaft and two worm gears each of which engages a spur gear on the front and rear axles. Traction and climbing characteristics are enhanced by overscale tires having highly pronounced treads. An optional 1.5 light bulb and light distributor simulates headlights.

6 Claims, 3 Drawing Figures

FOUR WHEEL DRIVE TOY VEHICLE

FIELD OF THE INVENTION

The invention relates to self-powered miniature toy vehicles capable of negotiating steep and irregular surfaces.

PRIOR ART

It is well know that the traction and climbing ability of four wheel vehicles can be improved by providing a drive train which supplies power to all four wheels. Because of their climbing ablility four wheel drive toys are very popular.

Until recently self-powered toy vehicles have been relatively large to accomodate wind-up spring or electric motors and conventional gear trains. The drive train systems used in these toys, particularly those having four wheel drives, have not been susceptible to miniaturization. There has simply not been sufficient space in toy vehicles of three inches in length or smaller to accomodate the motors and gears of larger toy cars.

In addition to the problems of miniaturization weight distribution has been a troublesome area for four wheel drive vehicles. If weight is not properly distributed the vehicle will tip over or lose traction when it reaches a grade.

Goldfarb et al. in U.S. Pat. 4,306,375 were able to develop a miniature four wheel drive vehicle by placing a motor and drive gears on one side of the frame and a AA battery on the other side. Using a small motor with a double-ended shaft and symmetrical gearing system at each end of the motor they were able to provide a toy vehicle which will climb grades up to about 40° without tipping over. However, the Goldfarb vehicle has serious limitations. It will not climb grades steeper than 40° . It uses a multipiece gear system having worm gears which can be easily removed and lost.

The present invention overcomes the limitations of the Goldfarb vehicle. I provide a four wheel drive miniature toy vehicle which will climb grades as steep as 50°. Furthermore, I provide a drive system which is less likely to come apart and whose pieces are less likely to become lost.

SUMMARY OF THE DISCLOSURE

I propose to provide a mimiature toy vehicle having four wheel drive and capable of climbing slopes as steep as 50°. I am able to achieve improved traction and climbing ability by placing the motor over the front wheels.

I prefer to provide a simple four piece gear system having only one part which is readily removable. Because that part is almost as long as the toy vehicle it is unlikely to be lost.

I also prefer to produce substantially all of my vehicle of plastic making it relatively inexpensive.

I further prefer to provide a small light bulb and light distributor to create "headlights" for the vehicle.

I also prefer to provide tires having high friction peripheral surfaces. Rubber tires having radially projecting teeth work well.

Other details, objects and advantages of the invention will become apparent as a description of a present preferred embodiment proceeds.

DESCRIPTION OF THE DRAWINGS

In the accompanying drawings, I have shown a present preferred embodiment of the invention in which.

DESCRIPTION OF THE PREFERRED EMBODIMENTS

Figure 1:
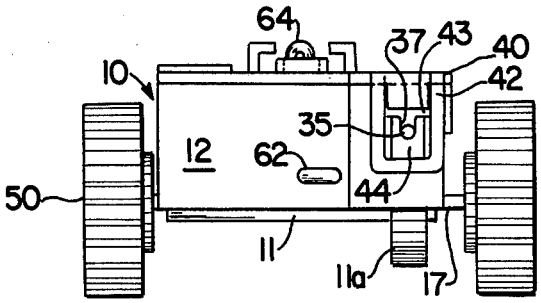
FIG. 1 is a front end elevational view of a present preferred embodiment of my vehicle.

Referring to the drawings I provide a box like chassis 10 having a base 11, ends 12 and 13, and sides 14 and 15. The base is molded so as to contain recesses **11*a* to accomodate spur gears 16 located on the front and rear axles 17 and 18. The axles 17 and 18 are positioned within or below the base so as to provide room in the chassis for a motor 20, drive train, battery and battery mounting. I mount a small electric motor 20 in the chassis above the front axle. The motor I prefer to use is about $\frac{3}{4}$ inch square and $\frac{3}{8}$ inch deep. A single drive shaft 22 extends through one side of the motor. A pinion 24 is attached to the end of the drive shaft 22**. By placing the motor above the front axle I provide additional weight over the front wheels which increases the vehicle's traction and climbing ability. My vehicle will climb grades of 50° and more particularly if the grade has a rough high friction surface.

The drive train is comprised of a propeller shaft 30 having a crown gear 32 at one end and worm gears 33 and 34. The worm gears are positioned so they will engage the spur gears 16 on the front and rear axles. Pins 35 and 36 are provided on the ends of the propeller shaft and sized to fit into notches 37 in ends 12 and 13. The propeller shaft is held in place by a cover 40 which fits over the motor and drive train. Tabs 42 extend from the front and rear of cover 40. A hole 43 provided in each tab which is sized to fit over a key 44 on chassis ends 12 and 13. When the tabs 42 are fitted over the keys 44 they will lock the pins 35 and 36 against the chassis holding the propeller shaft and cover in place. Being thus secured the propeller shaft will remain engaged with the spur gears 16. A crown gear 32 is provided on the end of the propeller shaft 30. The crown gear is sized and positioned so it will engage a pinion 24. I have found that a gear ratio of 32:1 is satisfactory. However, higher gear ratios could be used.

Figure 2:
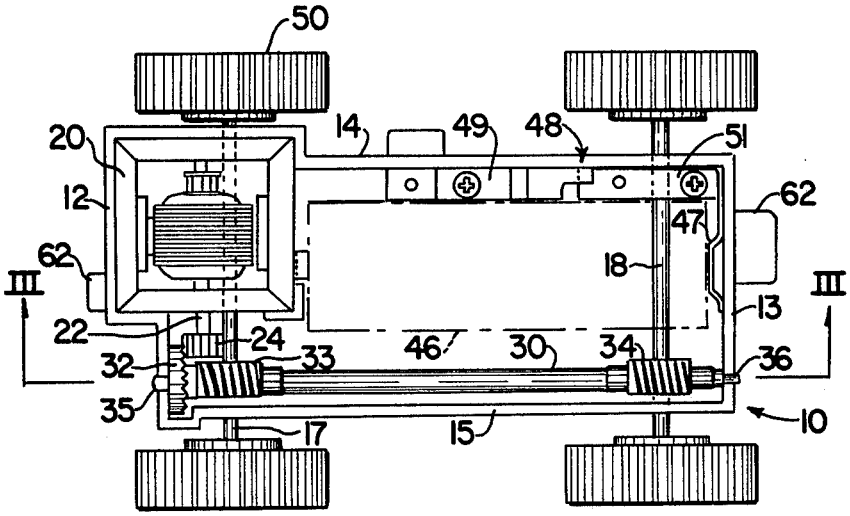
FIG. 2 is a top plan view of the embodiment of FIG. 1 without the battery cover and gear cover.

The vehicle is powered by an AA size dry cell battery 46 shown in chain line in FIG. 2. I prefer to abut the positive pole of the battery against the motor 20 and hold the battery in place with a brass spring clip 47 against the battery's negative pole. The clip 47 is wired through switch 48 to the motor. For my switch I prefer to use a brass plate 49 wired to the motor. Plate 49 can be moved to contact a second brass plate 51 attached to spring clip 47. Such a switch occupies very little space.

To improve traction I prefer to provide oversize tires 50 having highly pronounced treads. These tires are preferably overscale by a factor of two. I further prefer to use tires having radially extending teeth 52 and to make the tires of soft rubber or foam.

I have found that the use of oversized tires on a miniature vehicle having a motor positioned over the front wheels and a 32:1 gear ratio or greater enables the vehicle to climb very steep grades. Such a vehicle can rest on and grip surfaces of virtually any substance at grades up to 45°. Where the surface is a high traction substance the vehicle can climb grades in excess of 50°.

Figure 3:
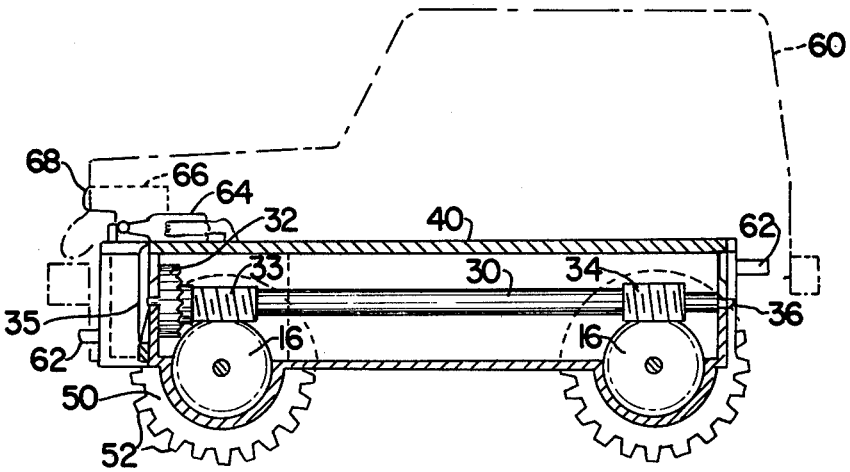
FIG. 3 is a cross-sectional view taken along the line III—III of FIG. 2 in which an optional vehicle body is shown in chain line.

As shown in FIG. 3 a body 60 can be fitted over the chassis. The body 60 is sized to fit over tabs 62 on the front and rear of the chassis which hold the body in place.

To provide "headlights" for the vehicle I mount a 1.5 volt light bulb 64 on the frame 10 or the gear cover 40. The light bulb is wired to the battery through switch 48 which also activiates the motor. Then I attach a substantially transparent light distributor 66 to the body. This distributor 66 fits through "headlight" holes 68 in the body and is positioned to fit over the light bulb when the body is attached to the frame.

In the foregoing specification I have set out a present preferred embodiment of my invention. However, it will be understood that this invention may be otherwise embodied within the scope of the following claims.

I claim:

1. A miniature self-powered, four wheel drive vehicle comprising:

(a) a frame;

(b) front wheel means and rear wheel means mounted to the frame for rotation about mutually parallel front and rear axes spaced about two inches apart, each of the wheel means having high friction peripheral surfaces;

(c) an electric motor mounted on the front of the frame so that its center of mass is not behind the front axis and having a driveshaft extending outwardly therefrom toward one side of the frame in a direction which is parallel to the front axis;

(d) pinion attached to an outwardly extending end of the driveshaft;

(e) a first spur gear attached to the front wheel means and positioned near the side of the frame toward which the driveshaft extends;

(f) a second spur gear attached to the rear wheel means and also positioned near the side of the frame toward which the driveshaft extends;

(g) a propeller shaft having opposite ends thereof supported by opposite ends of the frame and positioned perpendicular to and above the wheel axes and near the side of the frame toward which the drive shaft extends and having a crown gear at one end positioned to engage the pinion, a first worm gear positioned to engage the first spur gear and a second worm gear positioned to engage the second spur gear;

(h) battery holder means attached to the frame for releasably holding a standard AA size battery perpendicular to the wheel axes and approximately centered on the frame; and (i) means for electrically connecting the battery to the motor.

2. The vehicle of claim 1 also comprising tires mounted to the wheel means, the tires having a plurality of radially projecting teeth.

3. The vehicle of claim 1 also comprising a cover sized to conceal the motor, gears and propeller shaft and to hold the worm gears in engagement wiith the spur gears.

4. The vehicle of claims 1 or 3 also comprising a toy vehicle body mounted on the frame.

5. The vehicle of claim 1 also comprising (a) a light bulb mounted to the frame; and (b) means for electrically connecting the light bulb to the battery mounting means so that a battery located within the battery mounting means may energize the light bulb.

6. The vehicle of claim 5 also comprising a toy vehicle body mounted to the frame and a substantially transparent light distributor positioned so that light emitted from the light bulb will be transmitted through the light distributor.

* * * * *